United States Patent [19]

Martin et al.

[11] 4,120,078

[45] Oct. 17, 1978

[54] SIMULTANEOUS TEXTURIZING AND ENTANGLING OF FILAMENT BUNDLES

[75] Inventors: Wolfgang Martin, Ludwigshafen; Wolfgang Bauer, Heidelberg; Dieter Herion, Frankenthal; Hermann Linge, Carlsberg; Hans Knopp, Ludwigshafen, all of Fed. Rep. of Germany

[73] Assignee: BASF Aktiengesellschaft, Ludwigshafen, Fed. Rep. of Germany

[21] Appl. No.: 753,413

[22] Filed: Dec. 22, 1976

[30] Foreign Application Priority Data

Dec. 24, 1975 [DE] Fed. Rep. of Germany ..... 2558481
Jul. 19, 1976 [DE] Fed. Rep. of Germany ..... 2632384

[51] Int. Cl.[2] ..... D02G 1/16; D02G 3/34; D02J 1/06

[52] U.S. Cl. ..... 28/252; 28/255; 28/271

[58] Field of Search ..... 28/72.11, 72.12, 252, 28/255, 271, 273, 274, 253

[56] References Cited

U.S. PATENT DOCUMENTS

| | | | |
|---|---|---|---|
| 3,083,522 | 4/1963 | Rakowski et al. | 28/72.12 X |
| 3,481,558 | 12/1969 | Davies et al. | 28/252 X |
| 3,609,835 | 10/1971 | Boon | 28/252 X |
| 3,714,686 | 2/1973 | Schmid et al. | 28/72.12 X |
| 3,835,511 | 9/1974 | Schrader et al. | 28/252 |
| 3,889,327 | 6/1975 | Joly et al. | 28/72.12 |
| 4,007,518 | 2/1977 | Larson | 28/274 X |

*Primary Examiner*—Louis K. Rimrodt
*Attorney, Agent, or Firm*—Keil, Thompson & Shurtleff

[57] ABSTRACT

A process for the simultaneous texturizing and entangling of filament bundles by treating filament bundles of synthetic, high-molecular weight materials with a heated fluid in two tubular treatment chambers, in which process spatial or periodic irregularities are produced, in the treatment zones, in the flow of fluid and/or filament bundles. Preferably, a certain range of values of a volume mass flow factor is adhered to.

6 Claims, 3 Drawing Figures

SIMULTANEOUS TEXTURIZING AND ENTANGLING OF FILAMENT BUNDLES

Figure 1:
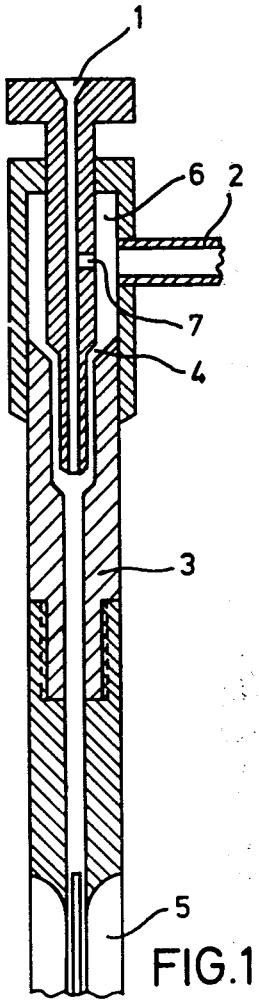

The entangling of continuous multifilaments to achieve better cohesion of the individual filaments, ie. interlacing, has been disclosed. Such entangled filament bundles are disclosed, for example, in U.S. Pat. Nos. 2,985,995 and 3,846,968. Other examples of entangling processes, and suitable apparatus, are described, for example, in Swiss Pat. No. 415,939, U.S. Pat. Nos. 3,187,847 and 3,543,358 and German Laid-Open Application DOS No. 1,660,176. Texturized yarns, especially those produced by jet crimping using hot fluids, have also been disclosed (compare, for example, German Laid-Open Application DOS No. 2,006,022). Hitherto, texturizing and entangling (interlacing) have in most cases been carried out in two separate process steps. Attempts to carry out crimping and entangling in one process step have, however, also been disclosed. An example is to be found in German Published Application DAS No. 2,110,394, which discloses that this object is achieved by using a special texturizing nozzle, a special finish and a certain minimum overfeed of the filament bundles. As regards the quality of the yarn obtained, all that is stated is that it exhibits high bulk, random three-dimensional crimping and good cohesion. U.S. Pat. Nos. 3,874,044 and 3,874,045 also disclose processes and equipment for texturizing and entangling. Both are carried out in one apparatus, but consecutively and in separate zones. In the first treatment chamber, the filament bundle is texturized by means of superheated steam, and in the second it is compressed, whilst still plastic, as it impinges on a wall of the chamber, thus becoming entangled. In a further chamber, another heat treatment is carried out. When operating the process on an industrial scale, it is difficult to achieve a uniform quality of the crimped and entangled filament bundles from a plurality of production units.

It is an object of the invention to provide a process for the simultaneous texturizing and entanglement of fiber bundles.

It is another object of the invention to provide such a process which can be operated easily, which does not require two or more steps and which allows the texturizing and entangling to be effected at high velocities.

We have found that these objects are achieved and that filament bundles of synthetic high molecular weight materials, which are passed through two successive tubular treatment zones, in which a hot fluid, which may or may not undergo resonant vibration in the two treatment zones, acts on the filaments, undergo simultaneous texturizing and entangling if, when bringing together the fluid and the filaments, or in the course of their travel through the treatment zones, spatial and/or periodic irregularities are produced in the flow of fluid and/or filament bundles.

The filament bundle is fed to a texturizing device consisting of two treatment zones. The filament bundle can be spin-drawn, i.e., it can be in the form obtained from the spinning process, or can be drawn or partially drawn, i.e., it can have undergone a separate partial or complete drawing process. It is passed, in the form taken off the bobbin at normal temperature, or after preheating, for example over heated godets, to the texturizing device and is brought together with the hot fluid in the said device. The ratio of the mass of the filament bundle per unit time to the mass of fluid per unit time, the temperature of the filament bundle when it encounters the fluid, and the temperature of the fluid and the velocity of the filament bundle and fluid must be matched in such a way that the plasticizing temperature appropriate to the particular polymer is reached without melting occurring.

The starting material used comprises synthetic high molecular weight materials such as are employed for the manufacture of filaments, especially linear filament-forming nylons, for example linear synthetic high molecular weight nylons with recurring amide groups in the main chain, linear synthetic high molecular weight polyesters with recurring ester groups in the main chain, filament-forming olefin polymers, filament-forming polyacrylonitrile or filament-forming acrylonitrile copolymers which predominantly contain acrylonitrile units, and, finally, cellulose derivatives, eg. cellulose esters. Suitable synthetic high molecular weight compounds are, for example, nylon-6, nylon-6,6, polyethylene terephthalate, linear polyethylene and isotactic polypropylene.

In the present context, the term "filament bundles" is to be understood as meaning continuous structures of individual filaments, e.g. flat filaments, or fibers produced from fibrillated films, film strips or tapes. The denier of the individual filaments may be, for example, from 1 to 32 dtex. Individual filaments of denier from 5 to 30 dtex are preferred. The number of individual filaments in the filament bundles may be from 2 to several hundred, eg. to 800. The use of filament bundles containing from 60 to 150 individual filaments is preferred. It is also clear from the foregoing that the filaments may have different cross-sections; for example they may be round or have a profiled cross-section, for example a trilobal cross-section.

The fluid used consists of the conventional gases for this purpose, eg. nitrogen, carbon dioxide, steam and, especially for economic reasons, air. The temperature of the fluid may lie within a wide range. A range of from 80° to 550° C. has in general proved suitable, but the most advantageous conditions for any particular material depend on the melting point or softening point of the material, the speed of sound in the fluid at the particular temperature and pressure employed, the time for which the fluid acts on the filament bundle, the temperature at which the filament bundle is fed into the apparatus and the denier of the individual filaments. Naturally, it is not possible to use temperatures which cause the filaments to melt under the chosen conditions, though the temperatures themselves may be above the melting point or decomposition point of the filament-forming material used, provided that the filaments are passed through the treatment zone at an appropriately high velocity and therefore with a low residence time. The higher is the velocity at which the filaments travel, the higher above the melting point or decomposition point of the filament-forming material used can the temperature of the fluid be.

The particular temperature to be used differs for the various filament-forming polymers and depends, as already mentioned, also on the denier of both the individual filaments and the filament bundle (ie. the individual denier and total denier). Thus, for example, the plasticization temperature ranges are from 80° to 90° C. for linear polyethylene, from 80° to 120° C. for polypropylene, from 165° to 190° C. for nylon-6, from 120° to 240° C. for nylon-6,6 and from 190° to 230° C. for polyethylene terephthalate.

The hot fluid used for crimping nylon 6 is preferably air heated to 250°–380° C. or superheated steam, the input pressure of the fluid preferably being greater than 3 bars and in particular from 5 to 9 bars. Because of the high working velocity of 1,200–2,000 m/min, the yarn temperature cannot become equal to the relatively high temperature of the fluid and therefore remains below the softening point of the polymer.

The first of the two treatment zones of the texturizing device usually consists of a yarn feed tube which leads, via an annular gap, to a coaxial yarn guide tube. At the annular gap, the fluid is brought into contact with the filament bundle passed through the yarn feed tube. The fluid then conveys the filament bundle through the yarn guide tube, which may or may not be heated, into the second treatment zone. This is so designed that the internal cross-section suddenly increases several-fold, eg. from 3-fold to 10-fold, and the fluid can flow out laterally, preferably through radial slots. In this region, the crimping of the filament bundle, which has been plasticized as a result of having been conveyed in the hot fluid, takes place in the vortices and vibrations of the fluid, caused by the leaving fluid. The dimensional conditions and flow conditions are preferably so chosen that the fluid undergoes resonant vibrations. The filament bundle which has been crimped and entangled leaves the second treatment zone and becomes stabilized very rapidly as a result of the temperature difference between the chamber and the exterior.

According to the invention irregularities are introduced into this dynamic system of hot fluid and travelling yarn bundle, these irregularities being either spatial or in respect of time, or both. Spatial irregularities are most simply induced by altering the flow geometry, for example by using non-circular shapes of the filament feed tube and/or of the second treatment zone, by asymmetrically guiding the filament bundle in the hot fluid, for example by eccentrically feeding the filament bundle, or by spatially irregular subjection of the filament bundle to hot fluid, by bringing about an additional flow of the hot fluid, if desired at a different temperature, on one or two adjacent sides, for example with the aid of one or more auxiliary nozzles in the filament feed tube or in the filament guide tube, or by lateral blowing of fluid. An enlargement of the cross-section of the filament feed tube at its end, for example a two-fold enlargement, produces a small entangling chamber where the filament bundle and fluid meet before entering the filament guide tube. By tangentially introducing the hot fluid into the annular gap, through which the fluid impinges on the filament bundle, the fluid receives a vortical movement as it encounters the filament bundle, thereby enhancing the entangling. Finally, eccentric rollers, over which the yarn runs before entering the first treatment zone, should also be mentioned (see FIG. 2). Such a roller causes the yarn to have a different velocity or tension on entering the yarn feed tube 1, leading to a substantially increased number of entanglement points.

Irregularities in respect of time can be brought about by periodic or aperiodic retardation or acceleration of the fluid or of the filament bundle. For example, the hot fluid can be introduced pulsatingly (under fluctuating pressure), or the filament bundle can be braked in narrow yarn feed tubes, in which the friction is so high that the feed no longer takes place uniformly. It is of advantage if the irregularity exerts an effect as soon as possible after the hot fluid encounters the filament bundle, rather than after the latter has passed through a substantial portion of the chamber or has been subjected for some time to a uniform action.

Figure 2:
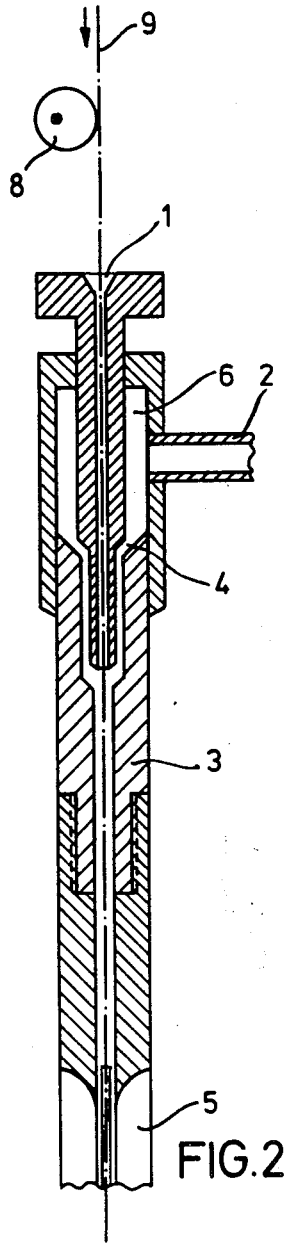
Figure 3:
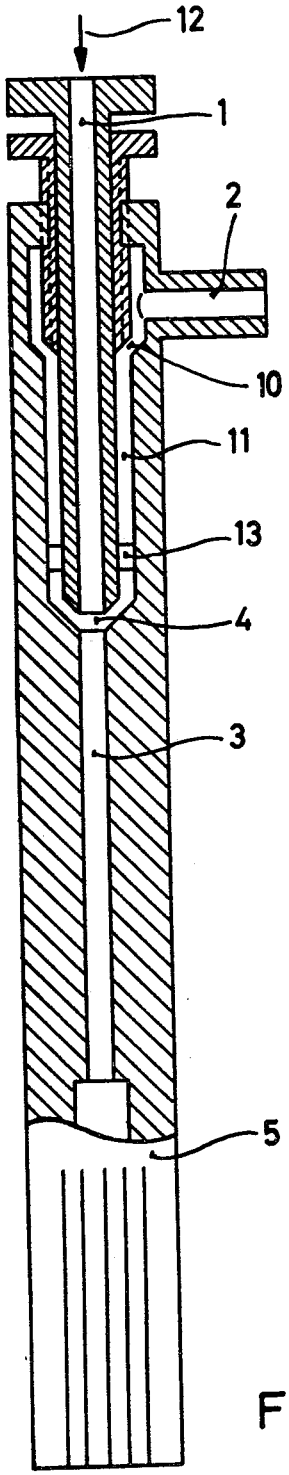

FIGS. 1, 2 and 3 serve to illustrate the spatial and periodic irregularities. The yarn to be crimped and entangled is drawn into the yarn feed tube 1 and, at the annular gap 4, encounters the fluid introduced through the feed nozzle 2 via the distribution space 6. The yarn and fluid conjointly pass through the yarn guide tube 3 and enter the slit nozzle 5, in which the fluid can expand, and escape, through the slots (the slit nozzle being as described in German Laid-Open Application DOS No. 2,006,022). The crimped yarn leaves the system and is chilled on the chilling drum or a travelling chilling screen (not shown in the drawing), and the crimp is frozen-in. The periodic and spatial irregularities required for entangling can be generated by various methods.

FIG. 1 shows one of these methods, namely asymmetrically blowing the fluid against the filament bundle in the filament feed tube, through an additional bore 7. This bore can direct the fluid centrally onto the filament bundle, but can also be in an eccentric position, so that the additional stream of air enters the filament feed tube tangentially.

FIG. 2 shows an arrangement distinguished by a particularly narrow cross-section of the filament feed tube. As a result of increased wall friction, irregularities, in respect of time, are produced at the yarn intake into the filament feed tube, causing the desired entanglement. An eccentric roller 8 can be provided upstream from the filament feed tube 1; the filament 9 runs over this roller and is thus subjected to the necessary irregularities as it enters the filament feed tube.

The filament feed tube either has such a narrow diameter that it offers a substantial frictional resistance to the yarn passing through it — which is the case if the condition $$\frac{\text{denier } (dtex)}{2 \times 1{,}000} = \text{diameter (mm)}$$

is satisfied — or one or more concentric bores are provided above the gap through which the fluid enters the yarn feed tube, which bores must not be too large, so that not too high a proportion of the heated fluid leaves the apparatus through the yarn inlet orifice, in countercurrent to the direction of travel of the yarn. If the filament feed tube has a diameter of 1.4 mm, suitable for deniers of from 800 to 3,300 detx, from 1 to 3 bores of diameter from 0.7 to 0.9 mm have proved suitable.

We have found that irregularities are very easily achieved by the following process for the manufacture of texturized entangled filament bundles from drawn or partially drawn filament bundles of synthetic high molecular weight materials: the filament bundles are passed by means of a heated fluid through a tubular first treatment zone and thereafter through a second tubular treatment zone, the gaseous medium from the second treatment zone being able to escape radially through slots running in the lengthwise direction, and on bringing the heated fluid together with the filament bundle to be treated, at the inlet to the first treatment zone, the flow velocity of the fluid is left substantially unchanged and a volume mass flow factor $$VM = \frac{G_{l1} + G_{g1}}{V_1}$$

of from 50 to 150 kg/m per $m^3$ is maintained; in this formula $V_1$ is the volume of the filament guide tube, expressed in units of length, and $G_{l1}$ is defined as $$G_{l1} = G'_1 \times \frac{1}{w_1}$$

whilst $G_{g1}$ is defined as $$G'_g \times \frac{1}{w_g},$$

$G'_l$ being the amount of the fluid and $G'_g$ the amount of filament passing per unit time, $w_l$ being the flow velocity of the fluid in the filament guide tube and $w_g$ the velocity of the filament bundle in the filament guide tube.

Accordingly, the parameters $G_{l1}$ and $G_{g1}$ have the dimensions of weights per unit length. The kg-m-h system of measurement is to be used for the numerical values.

In a suitable apparatus for carrying out the latter embodiment, the filament feed tube introduces the filament into a first treatment chamber, which is in the form of a nozzle, and the heated fluid then passes the filament through a filament guide tube. The crimping takes place in an elongate second treatment chamber, from which the heated fluid issues radially through lengthwise slots running in the direction of flow. In order to keep the volume mass flow factor within the specified range, it is advantageous to maintain a ratio of from 0.9 to 1.1 between the diameters of the filament guide tube and the filament feed tube, the ratio of the lengths of the said tubes being from 0.45 to 5.5. It has been found that the distance between filament feed tube and filament guide tube is advantageously from 0.2 to 10 times the diameter of the filament guide tube. In this advantageous apparatus, the fluid does not undergo any significant change in velocity on encountering the filament bundle, ie. the cross-section of the nozzle does not cause a significant diminution or increase in the velocity, a significant deviation being regarded as one of about 10%. Since the velocity of the fluid is advantageously from 50 to 95% of the speed of sound under the selected conditions, especially from 70 to 90%, it is not possible — as is customary — to bring about a higher velocity by narrowing the filament guide tube; instead the fluid must already flow at the desired velocity when brought together with the filament bundle. If the fluid does not have this velocity from the start, it can, in certain circumstances, be brought to this velocity by a pre-acceleration nozzle (which may simply consist of a narrowing of the cross-section).

Another apparatus which has proved advantageous for the process of the invention is shown schematically in FIG. 3. The fluid is fed via a feed tube 2 to a pre-acceleration nozzle 10, from where it flows through an annular channel 11 to the nozzle 4 in which the filament bundle and the fluid are brought together. The nozzle 4 is formed conjointly by the filament feed tube 1 and the filament guide tube 3. The space between the said tubes is to be regarded as the first treatment chamber, in the narrower sense. In actual fact, the treatment already occurs at the end of the filament feed tube 1 and extends to some degree, in the direction of travel of the filament 12, into the filament guide tube 3.

To permit accurate adjustment relative to the annular channel 11, the filament feed tube 1 can be provided with a distance piece 13. The pre-acceleration nozzle 10 and the nozzle 4 are adjustable independently of one another. The filament guide tube 3 is followed by the second treatment chamber 5, possessing radial slots.

The following conditions have proved of value in successfully carrying out the process:

When entering the filament guide tube, the fluid and the filament bundle should be brought together in such a way that the flow velocity of the fluid does not undergo a substantial change. This means that the free cross-sections of the nozzles should be selected in such a way that the fluid undergoes neither a substantial acceleration nor a substantial deceleration. This depdnds primarily on the velocity conditions in the annular channel 11 and filament guide tube 3 in the first treatment zone, but also on the cross-section occupied by the filament bundle conveyed through the first treatment zone (thereby reducing the free cross-section in this treatment zone). However, the cross-section is not the sole deciding factor, since frictional effects between the fluid and the wall of the treatment zone, between the fluid and the filament bundle, and between the filament bundle and the wall of the treatment zone also play a part. In addition to the fluid velocity, the velocity of the filaments also plays a part. The latter is conveniently specified in terms of material per unit time. It is advantageous to use throughputs $G'_g$ of from 6 to 25 kg/h, or even up to 30 kg/h, for diameters, of the filament guide tube 3, of from $1.0 \times 10^{-3}$ m to $2.7 \times 10^{-3}$ m.

The yarn obtained exhibits good crimp rigidities and an adequate number of entanglement points. The latter withstand a certain level of tensile stress during tufting but the degree of interlacing is not such as to be harmful to the appearance of articles made therefrom.

The crimp rigidity is used as a measure of the quality of the crimp. A hank of yarn is boiled for 5 minutes in water, left for 20 minutes at room temperature without applying tension, subjected to a load of 0.5 pond/dtex, at which load the length L is determined, and then released down to a load of 0.001 pond/dtex, to determine the value 1. The crimp rigidity is calculated from these lengths in accordance with the equation $$\frac{L - 1}{L} \times 100 = \text{rigidity in } \%.$$

The hook test is used to determine the spacing between entangled lengths. A 500 mm long yarn sample is clamped at one end onto a scale with millimeter divisions whilst at the other end it is subjected to a tensile force which corresponds to 0.2 times the filament denier but in total does not exceed 100 pond. The test is started at the clamped end; about 10 mm beyond the clamping point, the filament is split so that at least $\frac{1}{3}$ of the capillaries lie to the left, and $\frac{1}{3}$ to the right, of the pricking point. The pricking point itself should be in the central one-third. To determine the cohesion, a hook is drawn through the filament at from 10 to 20 mm per second until a tensile force of 10 pond is reached. This position is marked as a stop position. After each stop position, the hook is reinserted at intervals of 10 mm and the process is repeated as before, until the end of the filament has been reached. The distances between every two stop positions are used as numerical values. A total of 5 filament samples are measured for each such value and the individual results are averaged. The means value thus obtained is defined as the entanglement spacing and has the dimensions mm.

EXAMPLE 1

A 10,000–67 raw nylon-6 yarn runs via a draw device (feed godet 75° C., takeup godet 180° C., draw ratio 1:3.5) to the texturizing device shown in FIG. 1, at a velocity of 1,600 m/min. The yarn feed tube has a diameter of 1.3 mm and the yarn guide tube a diameter of 2.6 mm. Because of the friction, against the wall, of the filament bundle, which after having been drawn has a denier of 2,700, fluctuations of velocity occur in the yarn feed tube. The yarn is drawn off the texturizing nozzle at 1,100 m/min. 7 cubic meters (S.T.P.)/h of compressed air, at 6 atmospheres, which has been heated to about 370° C. are injected through the lateral nozzles. The slit width (the annular gap) between the yarn feed channel and the yarn guide tube is 0.3 mm.

The crimp rigidity of the yarn which has been texturized in this way is 12.7% after 5 minutes' boiling in water. In addition, the mean spacing of the entanglement points of the yarn is 30 mm, and disentanglement at these points only occurs after the yarn has been subjected 5 times to a tensile load greater than 0.5 p/dtex. If the experiment is carried out under the same conditions except that the yarn feed tube has an internal diameter of 1.4 mm, a texturized yarn with only a few very irregularly distributed entanglement points is obtained. The mean spacing of these is about 160 mm.

EXAMPLE 2

A raw nylon-6 yarn is drawn in the manner described in Example 1 (feed godet 75° C., takeup godet 180° C.) and travels at a velocity of 1,600 m/min to the texturizing device shown in FIG. 2. The yarn feed tube has a diameter of 1.4 mm and possesses a central bore of 0.7 mm diameter, 16 mm above the filament outlet end. 5.5 cubic meters (S.T.P.)/h of air, heated to 390° C., are introduced, under a pressure of 6.0 bars, through the lateral inlet nozzle, which enters the annular space around the yarn feed tube, at the level of the central bore. Because of the air which enters the yarn feed tube through the bore, the yarn bundle is passed asymmetrically through the yarn feed/yarn guide tube. The slit width (the annular gap) between the yarn feed tube and the yarn guide tube is 0.3 mm.

The crimp rigidity of the yarn texturized in this way is 9.9%. The entanglement points, which are readily visible in the yarn, have a mean spacing of 43 mm and only disentangle when the yarn is subjected 5 times to a tensile stress of 0.5 p/dtex.

EXAMPLE 3

A 10,000–67 nylon-6,6 yarn is drawn as described in Example 1 (feed godet 80° C., takeup godet 170° C.) and runs at a velocity of 1,600 m/min to the texturizing device shown in FIG. 1. The yarn feed tube has a diameter of 1.3 mm. 7.5 cubic meters (S.T.P.)/h of compressed air at 8 bars and 410° C. are injected through the lateral blow-nozzle. The texturized yarn is taken off at a velocity of 1,250 m/min. The slit width (the annular gap) between the yarn feed tube and the yarn guide tube is 0.25 mm.

The crimp ridigity of the yarn texturized in this way is 11.5% and the means spacing of the entangled lengths is 45 mm. The entangled lengths can only be disentangled when the tensile stress applied becomes 0.4 p/dtex.

If the experiment is carried out under the same conditions except that the yarn feed tube has a diameter of 1.5 mm, the yarn obtained has an equally good crimp but the mean spacing of the entanglement points is about 170 mm.

EXAMPLE 4

A raw nylon-6,6 yarn is fed as described in Example 1 through a texturizing device as described in Example 3, with the difference that the inlet nozzle for the fluid is mounted tangentially instead of radially. As a result, the fluid passing through the annular gap executes a vortical motion as it encounters the moving yarn. The yarn intake velocity is 1,650 m/min and the take-off velocity is 1,350 m/min. The diameter of the yarn feed tube is 1.4 mm. The volume of air blown in is 5.5 cubic meters (S.T.P.) at 390° C.

The crimp rigidity of the yarn thus produced is 12.5% and the mean spacing of the entangled lengths is 55 mm. The latter resist disentangling up to a tensile load of 0.4 p/dtex.

EXAMPLE 5

A 1,200–68 drawn raw nylon-6 yarn is fed at a velocity of 1,600 m/min to a texturizing device as shown in FIG. 2. The filament feed tube has an internal diameter of 1.45 mm and the fluid introduced is at 380° C. and an input pressure of 5.8 bars. At a distance of 150 mm upstream from the texturizing system inlet there is a double-sided eccentric (elliptical) roller having a major axis of 40 mm and a minor axis of 20 mm. The yarn is passed over this eccentric roller, thereby causing the latter to rotate. As a result, an irregularity in tension and velocity is produced in the yarn at intervals of about 45 mm amounting, in terms of time, to about 35,000 irregularities/min if the yarn velocity is 1,600 m/min. A yarn having a crimp of 11% and a mean spacing of the entangled lengths of 58 mm is obtained.

EXAMPLE 6

A 1,450–67 nylon filament was treated in a device such as that shown in FIG. 3. The following operating conditions were chosen:

| | |
|---|---|
| Texturizing air | 6.5 kg/h |
| Filament throughput | 9.6 kg/h |
| Volume mass flow factor | 73 kg/m per $m^3$ |
| Air temperature | 330° C |
| Temperature of the godet upstream from the inlet of the device | 133° C |

The entanglement spacing was 54 mm.

EXAMPLE 7

The procedure described in Example 6 is followed, but in addition 3.5 cubic meters (S.T.P.)/h of air at 22° C. are blown into the second treatment chamber. A crimped yarn with an entanglement spacing of 47 mm is obtained.

EXAMPLE 8

For comparison, the same starting material is treated under the following conditions by means of the device shown in FIG. 3;

| | |
|---|---|
| Texturizing air | 6.5 kg/h |
| Filament throughput | 8.6 kg/h |
| Volume mass flow factor | 28 kg/m per $m^3$ |
| Air temperature | 330° C |
| Temperature of th godet upstream from the inlet of the device | 110° C |

In this case, the entanglement spacing is 68 mm.

We claim:

1. A process for the manufacture of texturized and entangled filament bundles from drawn or partially drawn filaments of synthetic high molecular weight materials, by passing said filaments, by means of a heated fluid, through a tubular first treatment zone, and thereafter through a second tubular treatment zone from which the fluid can escape radially through slots running in the lengthwise direction, wherein, on bringing together the heated fluid with the filament bundle to be treated, at the inlet to the first treatment zone, the flow velocity of the fluid is left substantially unchanged, and in the first treatment zone a volume mass flow factor $$VM = \frac{G_{l1} + G_{g1}}{V_1}$$

of from 50 to 150 kg/m per $m^3$ is maintained, in which formula $V_1$ is the volume of the filament guide tube expressed in units of length and $G_{l1}$ is defined as $$G_{l1} = G'_1 \times \frac{1}{w_1}$$

and $Gg_1$ is defined as $$G'_g \times \frac{1}{w_g},$$

where $G'_l$ is the amount of fluid and $G'_g$ is the amount of filament passing per unit time, $w_l$ is the flow velocity of fluid in the filament guide tube and $w_g$ is the velocity of the filament bundle in the filament guide tube.

2. A process for the manufacture of texturized and entangled filament bundles, as set forth in claim 1, wherein the heated fluid is introduced into the first treatment zone at a velocity which is from 50 to 95% of the speed of sound under the prevailing conditions of temperature and pressure.

3. A process for simultaneously texturizing and entangling a filament bundle of synthetic high molecular weight material, which comprises: causing said filament bundle to flow through two successive tubular treatment zones and causing a flow of hot fluid to act on the filament bundle incident to the flow of said bundle through said zones, wherein at least one of said flows is asymmetrical.

4. A process as set forth in claim 3 which comprises producing resonance vibrations in said treatment zones.

5. A process as set forth in claim 3 which comprises producing irregularities at a point where the fluid and the filament bundle are brought together.

6. A process for simultaneously texturizing and entangling a filament bundle of synthetic high molecular weight material which comprises:

feeding the filament bundle to a texturizing device containing two treatment zones;

passing the filament bundle to a first treatment zone containing a feed tube, an annular gap and a coaxial guide tube, wherein the filament bundle is contacted with a flow of hot fluid at the annular gap, wherein the filament bundle is plasticized without melting and wherein the filament bundle is caused to flow through said zone, and conveying the filament bundle to a second treatment zone wherein the volume of the fluid is suddenly increased and the fluid flows out laterally, with the proviso that at least one of said flows in said zones is not uniform thereby producing a filament bundle which is simultaneously texturized and entangled.

* * * * *